US011512904B2

(12) United States Patent
Kreuz et al.

(10) Patent No.: US 11,512,904 B2
(45) Date of Patent: Nov. 29, 2022

(54) HEAT EXCHANGER

(71) Applicant: BASF SE, Ludwigshafen am Rhein (DE)

(72) Inventors: James P. Kreuz, Fort Smith, AR (US); Bryan L. Glidden, Freeport, TX (US); David M. Fierro, Freeport, TX (US)

(73) Assignee: BASF SE, Ludwigshafen am Rhein (DE)

( * ) Notice: Subject to any disclaimer, the term of this patent is extended or adjusted under 35 U.S.C. 154(b) by 94 days.

(21) Appl. No.: 17/255,204

(22) PCT Filed: Jun. 11, 2019

(86) PCT No.: PCT/EP2019/065097

§ 371 (c)(1),
(2) Date: Dec. 22, 2020

(87) PCT Pub. No.: WO2019/243102

PCT Pub. Date: Dec. 26, 2019

(65) Prior Publication Data

US 2021/0247141 A1 Aug. 12, 2021

Related U.S. Application Data

(60) Provisional application No. 62/688,645, filed on Jun. 22, 2018.

(30) Foreign Application Priority Data

Jul. 16, 2018 (EP) ..... 18183578

(51) Int. Cl.
*F25B 29/00* (2006.01)
*F28D 7/16* (2006.01)
*F28F 9/02* (2006.01)
*F28F 9/22* (2006.01)

(52) U.S. Cl.
CPC ..... *F28D 7/16* (2013.01); *F28F 9/0278* (2013.01); *F28F 9/22* (2013.01); *F28F 2265/10* (2013.01); *F28F 2270/00* (2013.01)

(58) Field of Classification Search
CPC ... F28D 7/16; F28F 9/0278; F28F 9/22; F28F 2265/10; F28F 2270/00
USPC ..... 165/158
See application file for complete search history.

(56) References Cited

U.S. PATENT DOCUMENTS 4,421,160 A * 12/1983 Stafford ..... F28F 9/0229 156/303.1
2005/0035591 A1* 2/2005 Graham ..... F28F 9/06 285/123.2
2013/0112381 A1 5/2013 Valente

FOREIGN PATENT DOCUMENTS

EP 1586370 A2 10/2005
GB 2126116 A 3/1984
JP 11-013551 A 1/1999

OTHER PUBLICATIONS

European Search Report for EP Patent Application No. 18183578.6, dated Nov. 27, 2018, 3 pages.

(Continued)

*Primary Examiner* — Davis D Hwu
(74) *Attorney, Agent, or Firm* — Faegre Drinker Biddle & Reath LLP

(57) ABSTRACT

The presently claimed invention relates to a heat exchanger and a method of exchanging heat.

19 Claims, 2 Drawing Sheets

(56) References Cited

OTHER PUBLICATIONS

International Preliminary Report on Patentability received for PCT Patent Application No. PCT/EP2019/065097, dated Dec. 30, 2020, 8 pages.
International Search Report and Written Opinion received for PCT Patent Application No. PCT/EP2019/065097, dated Oct. 22, 2019, 9 pages.

* cited by examiner

HEAT EXCHANGER

CROSS-REFERENCE TO RELATED APPLICATIONS

This application is a national stage application (under 35 U.S.C. § 371) of PCT/EP2019/065097, filed Jun. 11, 2019, which claims benefit of U.S. Application 62/688,645, filed Jun. 22, 2018, and European Application No. 18183578.6, filed Jul. 16, 2018, all of which are incorporated herein by reference in their entirety.

FIELD OF INVENTION

The presently claimed invention relates to a heat exchange device and a method of exchanging heat.

BACKGROUND OF INVENTION

Heat transfer is an important part of many processes in varied industries. In general, heat transfer involves at least one stream which is at high temperature and at least one other stream which is at low temperature, brought in contact with each other either in a direct manner or in an indirect manner to heat or cool, through heat transfer.

Heat exchangers are equipment typically used for indirect heat exchange between, at least two streams. The choice of a particular type of heat exchanger is dependent on the temperature difference between the two streams, the chemical nature of the streams, and the available installation space. Nevertheless, the most widely used heat exchangers are generally described as double pipe heat exchangers, shell and tube heat exchangers, and/or plate heat exchangers. Of these, shell and tube heat exchangers find wide application in almost all industries. A shell and tube heat exchanger majorly comprises a shell which contains a plurality of tubes disposed on the interior of the shell and wherein at least one of the streams flows around the tubes, while the plurality of tubes is bundled together in the form of tube bundles and wherein at least one of the other streams flows through the tubes. The streams, in the shell side as well as the tube side, may flow in a direction parallel, counter-current, or cross-flow to each other.

JP 11013551 discloses an EGR (exhaust gas recirculation) cooler for cooling the exhaust gas using a coolant of an engine. The FIG. 10 discloses the EGR cooler. The chamber 21 in the EGR cooler is having an inlet 25 and an out let 26 for the continuous flow of a coolant in order to suppress the boiling of the inlet fluid. Therefore, a continuous heat exchange process is involved between the continuous flow of coolant in chamber 21 and the inlet fluid. JP 11013551 further discloses that the chamber 21 can be used for introducing a higher boiling liquid such as lubricating oil, or light oil etc having a higher boiling point in order to increase the efficiency of the cooling.

US 2013/112381 A1 describes a heat exchange device comprising plurality of tubes arranged parallel to one another to form one or more tube bundles inserted axially in a cylindrical shell. A first fluid supplied through one or more first inlet holes at a first end of the cylindrical shell and oriented axially, flows inside the tubes and a second fluid, supplied through a second inlet hole, flows inside the cylindrical shell to effect heat transfer with the first fluid through the tube walls.

One end of the tubes is connected to a tube plate at first inlet hole(s), which separates the second fluid from the first fluid. At least two impingement plates, each provided with plural through holes, are placed in succession between each first inlet hole and the tube plate. The impingement plates are parallel to one another and orthogonal to the cylindrical shell central axis to distribute the first fluid inside the tubes.

GB 2 126 116 A describes an evaporator including a plurality of vertical heat transfer tubes, a liquid inlet plenum enclosing the lower ends of the tubes, a distributor plate located within the inlet plenum and having a multiplicity of orifices therethrough, said distributor plate being spaced apart from the inlet ends of the tubes to define a manifold, which interconnects said inlets to allow cross flow.

EP 1 586 370 A2 describes a reactor arrangement for carrying out catalytic gas phase reactions, comprising a jacket tube reactor (2), a bundle of tubes and a separate, after cooler (3) directly connected to the side outlet, where the cross sectional area in the after cooler is essentially congruent with the cross sectional area in the jacket and both the cross sectional areas are oppositely paired in large numbers.

While almost all kinds of streams, irrespective of their temperature, can be cooled or heated in the shell and tube heat exchanger, there are some conditions where these heat exchangers do not result in an efficient heat exchange between the streams. One such condition arises when the stream on one side of the exchanger, say in the tube side, is near its boiling point. In such conditions, the stream on the other side of the exchanger, here the shell side stream, can excessively heat the tube side stream to its boiling point, thereby causing violent disruptive boiling of the tube side stream. This causes a non-uniform distribution of the tube side stream inside the tube, thus, resulting in an inefficient heat exchange between the shell side and the tube side streams. Additionally, this also results in loss of the tube side stream due to vapor formation, thereby increasing the operational cost of the exchanger.

Thus, it is an objective of the presently claimed invention to provide a heat exchanger which does not result in violent disruptive boiling of the tube side stream, thereby resulting in the uniform distribution of the tube side stream with minimal or no loss.

SUMMARY OF THE INVENTION

Surprisingly, it has been found that the above defined object is achieved by inserting an insulation tube sheet between the distributor assembly and the shell side outlet of a heat exchanger. The insertion of the insulation tube sheet creates an inlet insulation space between the distributor assembly and insulation tube sheet. The creation of the inlet insulation space not only resolves the problems associated with the overheating of the tube side stream at the distribution assembly, but also reduces the amount of the shell side stream required for heat exchange between the tube side stream and the shell side stream, thereby resulting in additional cost saving and rendering the heat exchange process economic.

Accordingly, in one aspect, the presently claimed invention is directed to a heat exchanger (100) comprising:

a shell (101);

a tube side inlet (106) and a tube side outlet (107);

a shell side inlet (105) and a shell side outlet (104);

a plurality of tubes (102);

a distribution assembly (108);

an inlet tube sheet (114) and an outlet tube sheet (112); and an insulation tube sheet (103);

wherein, the insulation tube sheet (103) is arranged between the distributor assembly (108) and the shell side outlet (104) to create an insulation space (109) there between; and the tubes (102) are fitted inside the shell (101) between the distributor assembly (108) and the outlet tube sheet (112) and are in communication with the tube side inlet (106) through the distributor assembly (108) and the tube side outlet (107).

In another aspect, the presently claimed invention is directed to a method of exchanging heat using the above heat exchanger, comprising the steps of:

i. feeding a tube side stream through said tube side inlet (106) to said distributing assembly (108),
ii. passing the tube side stream through said plurality of tubes (102),
iii. feeding a shell side stream through said shell side inlet (105) and
iv. exchanging the heat between the tube side stream in the plurality of tubes (102) with the shell side stream, wherein the temperature of at least one of the liquid components of the tube side stream entering through the tube side inlet (106) to the distributing assembly (108) is near its boiling point; and the temperature of the shell side stream entering through the shell side inlet (105) is higher than at least one of the liquid components of the tube side stream at distributing assembly (108).

In another aspect, the presently claimed invention is directed to a method of concentrating a liquid using a falling film heat exchanger as described herein comprising the steps of:

i. feeding a tube side stream through said tube side inlet (106) to said distributing assembly (108),
ii. passing the tube side stream through said plurality of tubes (102) having an inner wall and forming a film of the tube side stream along the inner wall,
iii. feeding a shell side stream through said shell side inlet (105),
iv. exchanging the heat between the tube side stream in the plurality of tubes (102) with the shell side stream, and
v. obtaining a concentrated stream through said tube side outlet (107) of the shell; wherein, the temperature of the tube side stream entering through the tube side inlet (106) to the distributing assembly (108) is near its boiling point; and the temperature of the shell side stream entering through the shell side inlet (105) is higher than the tube side stream at the distributing assembly (108).

BRIEF DESCRIPTION OF THE DRAWINGS

The presently claimed invention is described in conjunction with the appended figures:

DETAILED DESCRIPTION OF THE INVENTION

Figure 1:
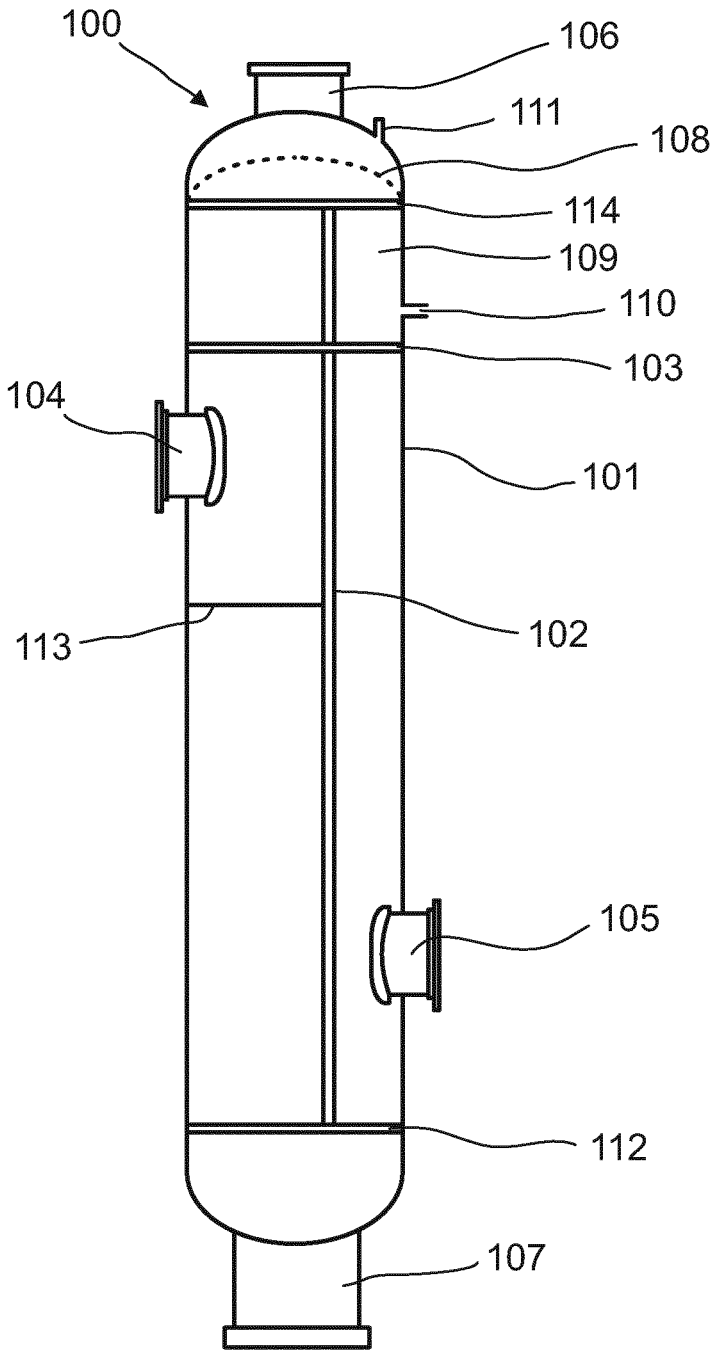
FIG. 1 is a schematic diagram showing a heat exchanger as per the presently claimed invention.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It is being understood that various changes may be made in the function and arrangement of elements without departing from the spirit and scope of the invention as set forth in the appended claims. It is also to be understood that the terminology used herein and the figure described herein is not intended to be limiting, since the scope of the presently claimed invention will be limited only by the appended claims.

If hereinafter a group is defined to comprise at least a certain number of embodiments, this is meant to also encompass a group which preferably consists of these embodiments only. Furthermore, the terms "first", "second", "third" or "(a)", "(b)", "(c)", "(d)" etc. and the like in the description and in the claims, are used for distinguishing between similar elements and not necessarily for describing a sequential or chronological order. It is to be understood that the terms so used are interchangeable under appropriate circumstances and that the embodiments of the presently claimed invention described herein are capable of operation in other sequences than described or illustrated herein. In case the terms "first", "second", "third" or "(A)", "(B)" and "(C)" or "(a)", "(b)", "(c)", "(d)", "i", "ii" etc. relate to steps of a method or use or assay there is no time or time interval coherence between the steps, that is, the steps may be carried out simultaneously or there may be time intervals of seconds, minutes, hours, days, weeks, months or even years between such steps, unless otherwise indicated in the application as set forth herein above or below.

Furthermore, the ranges defined throughout the specification include the end values as well, i.e. a range of 1 to 10 implies that both 1 and 10 are included in the range. For the avoidance of doubt, the applicant shall be entitled to any equivalents according to the applicable law.

Reference throughout this specification to "one embodiment" or "an embodiment" means that a particular feature, structure or characteristic described in connection with the embodiment is included in at least one embodiment of the presently claimed invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some, but not other features included in other embodiments, combinations of features of different embodiments are meant to be within the scope of the presently claimed invention, and form different embodiments, as would be understood by those in the art. For example, in the appended claims, any of the claimed embodiments can be used in any combination.

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments.

Also, it is noted that the individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in all embodiments. A process may correspond to a method, a function, a procedure, etc.

Furthermore, embodiments of the invention may be implemented, at least in part, either manually or automatically. Manual or automatic implementations may be executed, or at least assisted, through the use of machines, hardware, software, firmware, middleware, microcode, hardware description languages, or any combination thereof.

Various reference numerals are described hereinbelow:

| Reference numeral | Description |
|---|---|
| 100 | Heat exchanger |
| 101 | Shell |
| 102 | Plurality of tubes |
| 103 | Insulation tube sheet plate |
| 104 | Shell side outlet |
| 105 | Shell side inlet |
| 106 | Tube side inlet |
| 107 | Tube side outlet |
| 108 | Distribution assembly |
| 109 | Inlet insulation space |
| 110 | Nozzle |
| 111 | Flow aiding inlet |
| 112 | Outlet tube sheet plate |
| 113 | Baffle plate |
| 114 | Inlet tube sheet plate |
| 1081 | distributing plate with multiple holes |

An aspect of the presently claimed invention provides for a heat exchanger, as shown in FIG. 1.

The heat exchanger (100) comprises:

a shell (101);

a tube side inlet (106) and a tube side outlet (107);

a shell side inlet (105) and a shell side outlet (104);

a plurality of tubes (102);

a distribution assembly (108);

an inlet tube sheet (114) and an outlet tube sheet (112); and an insulation tube sheet (103);

wherein, the insulation tube sheet (103) is arranged between the distributor assembly (108) and the shell side outlet (104) to create an insulation space (109) there between; and the tubes (102) are fitted inside the shell (101) between the distributor assembly (108) and the outlet tube sheet (112) and are in communication with the tube side inlet (106) through the distributor assembly (108) and the tube side outlet (107).

In one embodiment, the heat exchanger of the presently claimed invention is an evaporator, and in yet another embodiment a falling film evaporator.

The shell (101) is a container or a vessel for the shell side stream in the heat exchanger, as described hereinabove, having any pre-defined shape and size. The shell (101) can be oriented horizontally or vertically and has a material of construction well-known to a person skilled in the art. For instance, it can be made out of a sheet metal. The present invention is not limited by the shape, size, orientation and material of construction of the shell (101). However, in an embodiment, the heat exchanger is disposed vertically.

The shell (101) can be custom designed for operating in any capacity and conditions, such as from high vacuum to ultrahigh pressure (more than 10 MPa) and from cryogenics to high temperatures (1100° C.), and any temperature and pressure differences between the shell side and tube side streams. For instance, steam at a pressure of about 1.3 MPa and about 260° C., a pressure of about 0.4 MPa and about 150° C., and a pressure of about 0.6 MPa and about 35° C. can all be employed as shell side stream.

In an embodiment, the shape of the shell (101) is cylindrical or rectangular, and in another embodiment the shape of the shell (101) is cylindrical. The shell (101) may be, such as but not limited to, a one pass shell, two pass shell with longitudinal baffle, split flow, double split flow, divided flow, kettle type, cross flow having the designated notations E, F, G, H, J, K, X respectively, as prescribed by the Tubular Exchanger Manufacturers Association (also referred as TEMA).

As prescribed by TEMA, the heat exchanger has a front head and a rear head. The front head types are selected from a channel and removable cover (A), a bonnet (B), a channel integral with tube sheet and removable cover (C and N), and a special high-pressure closure (D). The rear heads are selected from fixed tube sheet like an "A" stationary head (L), a fixed tube sheet like "B" stationary head (M), a fixed tube sheet like "C" stationary head (N), an outside packed floating head (P), a floating head with backing device (S) and a pull through floating head (T), an U-tube bundle (U) and a packed floating tube sheet with lantern ring (W).

The tube side inlet (106) allows the ingress and tube side outlet (107) allows the egress of the of tube side stream. The tube side inlet (106) and the tube side outlet (107) could be on the opposite side or on the same side, depending on the type of heat exchanger that is being used. For instance, in a simple shell and tube exchanger is used, the tube side inlet (106) is on one side of the shell and the tube side outlet (107) is on the opposite side. If the heat exchanger is a shell and tube exchanger with one shell pass and two tube passes, the tube side inlet (106) and the tube side outlet (107) are on the same side. In an embodiment, the tube side inlet (6) is on one side and the tube side outlet (107) is on the opposite side of the shell (101).

In another embodiment, the plurality of tubes (102) is fitted on the tube sheet or tube plate to obtain the tube bundle. The tube bundle is housed in the shell (101) establishing a space between its inner wall of the shell and the outside of the tubes of the tube bundle where the shell side stream circulates. Although, only a single tube is illustrated in FIG. 1, it is to be understood that in practice, the heat exchanger can have a plurality of such tubes. The tubes are all arranged parallel to each other and are open at both ends. The inner wall of the tubes is smooth so that the flow of the tube side stream in the form of a thin film along the inner wall is not hindered, decelerated, or met with resistance. The present invention is not limited by the choice of tube, its material of construction, number of tubes and the tube bundle itself. These are well-known to the person skilled in the art and the same can be varied depending on, such as but not limited to, the tube and shell side stream and the temperature difference between the two.

The outer wall of the tubes (102) of the heat exchanger, described hereinabove, is either smooth or finned, and in some embodiments the wall of the tubes is finned. The tubes of the presently claimed invention are made of, such as but not limited to, carbon steel, copper, admiralty, brass, copper-nickel, stainless steel, muntz metal, aluminium, aluminium bronze, hastalloy, Inconel and titanium. The tube bundle is of any shape such as but not limited to, straight or U-shape, and in some embodiments is straight. The plurality of tubes are fitted on the tube sheet to obtain the tube bundle. The tube sheet may be fitted on either side of the shell (101) to support the tube bundle. The tube sheets close the inner space at the ends of the tube bundle effectively. The number of tubes inside the shell (101) may be in the range of from several dozen to several hundreds to over one thousand. It is customary for the person skilled in the art to determine the number and dimension of the tubes depending on the desired capacity, conditions, and other parameters of the material and apparatus.

In another embodiment the shell side inlet (105) allows the ingress and the shell side outlet (104) allows the egress of the shell side stream.

In another embodiment, the tube side stream is a liquid having a temperature near its boiling point. The tube side stream can be a mixture of liquid components having at least one of the component is near its boiling point. Further, the mixture of liquid components, may form an azeotropic mixture, in such case the temperature of the tube side stream is near the boiling point of the azeotropic mixture, while the shell side stream can be a single fluid or a mixture of fluids, such as but not limited to, steam, hot water, oil and air.

Figure 2:
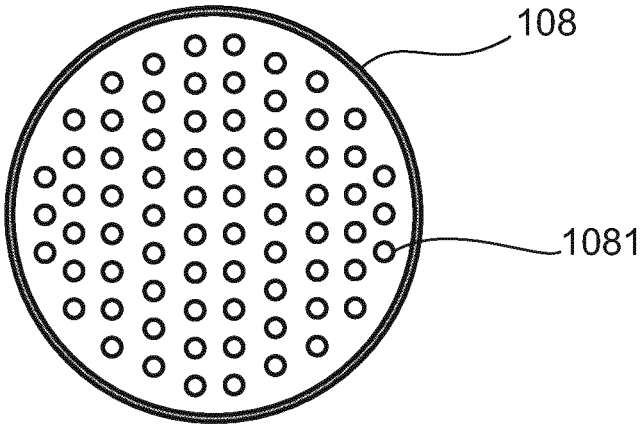
FIG. 2 is an enlarged top view of a distributor plate showing a plurality of tube openings.

In another embodiment, the heat exchanger of the presently claimed invention contains a distributing assembly (108) below the tube side inlet, as shown in FIG. 2, which helps in distribution of the tube side stream before entering into the plurality of tubes (102) and facilitates the formation of a thin film along the inner wall of the tubes (102). In the distributing assembly, one or more distributing trays may be used. The distributing tray can be of any shape, however, in some embodiments the distributing tray comprises a round disc. The distributing tray of the distributing assembly (108) has multiple holes (1081) through which the tube side stream flows and is distributed. The diameter of the holes (1081) on the distributing tray are in the range of about 1 to 100 mm, and in some embodiments from 5 to 50 mm, and in still other embodiments from 8 to 25 mm. The diameter of each and every tube in the tube bundle may have the same diameter or may vary. The multiple holes (1081) on the distributing assembly (108) are laid out on a square pitch, a triangular pitch and a hexagonal pitch.

In another embodiment the heat exchanger, as described hereinabove, comprises an insulating tube sheet (103), which is arranged between the distributor assembly (108) and the shell side outlet (104) to create an insulation space (109) between the distribution assembly (108) and the insulating tube sheet (103). The insulation space (109) created between the distribution assembly (108) and the insulating tube sheet (103) protect the tube side stream at the distribution assembly coming into contact with the shell side stream. The insulation space created, thereby protects the tube side stream from the violent disruptive boiling at the distributing assembly and lead to the uniform distribution of the tube side stream along the inner walls of the tubes and an efficient heat exchange between the shell side and the tube side streams. Additionally, it also protects the tube side stream from the loss due to the vapor formation.

The position of the insulating tube sheet (103) relative to the distributor assembly (108) is based on the temperature and boiling point of the tube side stream and the temperature of the shell side stream. For instance, the insulating tube sheet (103) is placed close to the shell side outlet if the difference between in the boiling point and temperature of the tube side stream is less than 15° C., or 10° C. When the temperature difference is greater, the insulating tube sheet (103) may be placed further from the shell side outlet.

In another embodiment, the insulation space (109) is fitted with a vent nozzle (110) in order to ensure that no liquid is present in the space. The thickness of the inlet insulation tube sheet is in the range of 5 mm to 100 mm, and in some embodiments from 10 mm to 50 mm. The shape of the insulating tube sheet (103) depends on the shape of the shell, however, in some embodiments it is in the shape of a circular disc.

In another embodiment, the insulation space (109) is filled with air.

In another embodiment, the insulating tube sheet (103) is made of a heat resistant material or metal. In some embodiments, the heat resistant material is teflon. In a regular heat exchanger, the inlet tube sheet (114) is in contact with both the tube side stream and the shell side stream, whereas in the presently claimed heat exchanger the inlet tube sheet (114) is only in contact with the tube side stream as the insulation tube sheet (103) will protect the inlet tube sheet (114) from coming in contact with the shell side stream.

In one embodiment the heat exchanger, as described hereinabove, comprises second insulation space at the tube side outlet. However, in another embodiment the heat exchanger, as described hereinabove, does not comprise an insulation space at the tube side outlet and only contains an insulation space at the tube side inlet.

In another embodiment, the heat exchanger is a one-stage or a multi-stage heat exchanger having each stage of the heat exchangers connected in series. If the heat exchanger is a multi-stage heat exchanger, the insulating tube sheet (103) is arranged between the distributor assembly (108) and the shell side outlet (104) for each heat exchanger.

In another embodiment, the heat exchanger comprises at least one baffle (113). Baffles serve two important functions. Firstly, they support the tubes (102) during assembly and operation and help to prevent the vibration from flow-induced eddies. Secondly, they direct the shell-side stream back and forth across the tube bundle to provide effective velocity and heat transfer rates. The baffles in the presently claimed apparatus may be longitudinal baffles or transverse baffles for directing the shell-side fluid back and forth across the shell. The baffles may be of a single segmental, a double segmental, an orifice, a disc and a doughnut type etc. The present invention is not limited by the choice of such baffles.

Optionally, one or more flow-aiding inlets (111), for example steam inlets, are installed in the heat exchanger. In some embodiments, four to six flow-aiding inlets (111) are installed, which may be steam inlets. In the heat exchanger, a flow aid, for example steam, enters into the tubes (102) through the flow-aiding inlets (111), while the tube side stream to be heat exchanged enters into the tube (102) from the inlet (106). The flow aid in motion moves co-currently with the tube side stream, thereby assisting the tube side stream to flow along the inner wall of the tube at an accelerated rate.

In another aspect, the presently claimed invention is directed to a method of exchanging heat using a heat exchanger as described hereinabove, comprising the steps of:

i. feeding a tube side stream through said tube side inlet (106) to said distributing assembly (108),
ii. passing the tube side stream through said plurality of tubes (102),
iii. feeding a shell side stream through said shell side inlet (105) and
iv. exchanging the heat between the tube side stream in the plurality of tubes (102) with the shell side stream, v. wherein the temperature of at least one of the liquid components of the tube side stream entering through the tube side inlet (106) to the distributing assembly (108) is near its boiling point; and vi. the temperature of the shell side stream entering through the shell side inlet (105) is higher than at least one of the liquid components of the tube side stream at distributing assembly (108).

The tube side stream is introduced into the heat exchanger via the tube side inlet (106) into the distribution assembly (108). The tube side stream is distributed in equal quantities in each tube, thereby forming counter current flows which exchange heat with the shell side stream via the surface of the tubes themselves. The shell side stream therefore converges at the outlet of the tubes. The tube side outlet (107) collects the heat exchanged tube side stream and the shell side outlet (104) allows the exit of the shell side stream from the heat exchanger.

In another embodiment, the tube side stream comprises one or more liquid components, wherein the temperature of at least one of the liquid components of the tube side stream entering through the tube side inlet (106) to the distributor assembly (108) is less than $T_b$−15° C., wherein $T_b$ is the boiling point of at least one of the liquid components of the tube side stream which is near its boiling point or boiling point of said azeotropic mixture. In some embodiments, the temperature of at least one of the liquid components of the tube side stream entering through the tube side inlet (106) to the distributor assembly (108) is less than $T_b$−10° C., wherein $T_b$ is the boiling point of at least one of the liquid components of the tube side stream which is near its boiling point or boiling point of said azeotropic mixture. In other embodiments, the temperature of at least one of the liquid components of the tube side stream entering through the tube side inlet (106) to the distributor assembly (108) is less than $T_b$−5° C., wherein $T_b$ is the boiling point of at least one of the liquid components of the tube side stream which is near its boiling point or boiling point of said azeotropic mixture.

For instance, the tube side stream is a mixture of two or more liquids and each component boils independently, then the $T_b$ is the boiling point of the component which boils first. Another instance is when the tube stream is a mixture of two or more liquids which form an azeotropic mixture, then the $T_b$ is the boiling point of the azeotropic mixture.

In another embodiment, the temperature of the shell side stream is more than $T_b$+5° C., wherein $T_b$ is the boiling point of at least one of the liquid components of the tube side stream which is near its boiling point or boiling point of said azeotropic mixture formed by the mixture of the components in the tube side stream. In some embodiments the temperature of the shell side stream is more than $T_b$+10° C., wherein $T_b$ is the boiling point of at least one of the liquid components of the tube side stream which is near its boiling point or boiling point of said azeotropic mixture formed by the mixture of the components in the tube side stream. In still other embodiments the temperature of the shell side stream is more than $T_b$+15° C., wherein $T_b$ is the boiling point of at least one of the liquid components of the tube side stream which is near its boiling point or the boiling point of said azeotropic mixture formed by the mixture of the components in the tube side stream.

In another embodiment, the method of exchanging heat comprises feeding a gas through the flow-aiding inlet (111) and flowing the gas in the same direction as the tube side stream, wherein the velocity of the tube side stream is accelerated by the flow-aiding gas along the inner wall of the plurality of tubes (102).

In another aspect, the invention is directed to a method of concentrating a liquid using a falling film heat exchanger as describe above comprising the steps of:

i. feeding a tube side stream through said tube side inlet (106) to said distributing assembly (108), ii. passing the tube side stream through said plurality of tubes (102) by forming a film of the tube side stream along the inner wall of said plurality of tubes, iii. feeding a shell side stream through said shell side inlet (105), iv. exchanging the heat between the tube side stream in the plurality of tubes (102) with the shell side stream, and v. obtaining a concentrated stream through said tube side outlet (107) of the shell; wherein, the temperature of the tube side stream entering through the tube side inlet (106) to the distributing assembly (108) is near its boiling point; and the temperature of the shell side stream entering through the shell side inlet (105) is higher than the tube side stream at the distributing assembly (108).

In another embodiment, the shell side stream is selected from steam, water, oil, air, the secondary steam from a previous stage heat exchanger, or a combination thereof.

In another embodiment, the tube side stream comprises one or more liquid components, wherein the temperature of at least one of the liquid components of the tube side stream entering through the tube side inlet (106) to the distributor assembly (108) is less than $T_b$−15° C., wherein $T_b$ is the boiling point of at least one of the liquid components of the tube side stream near its boiling point or boiling point of the azeotropic mixture formed by the mixture of components in the tube side stream. In some embodiments the temperature of at least one of the liquid components of the tube side stream entering through the tube side inlet (106) to the distributor assembly (108) is less than $T_b$−10° C., wherein $T_b$ is the boiling point of at least one of the liquid components of the tube side stream near its boiling point or boiling point of the azeotropic mixture formed by the mixture of components in the tube side stream. In still other embodiments, the temperature of at least one of the liquid components of the tube side stream entering through the tube side inlet (106) to the distributor assembly (108) is less than $T_b$−5° C., wherein $T_b$ is the boiling point of at least one of the liquid components of the tube side stream near its boiling point or boiling point of the azeotropic mixture formed by the mixture of components in the tube side stream.

In another embodiment, the temperature of the shell side stream is more than $T_b$+5° C., wherein $T_b$ is the boiling point of at least one of the liquid components of the tube side stream near its boiling point or boiling point of the azeotropic mixture formed by the mixture of components in the tube side stream. In some embodiments, the temperature of the shell side stream is more than $T_b$+10° C., wherein $T_b$ is the boiling point of at least one of the liquid components of the tube side stream near its boiling point or boiling point of the azeotropic mixture formed by the mixture of components in the tube side stream. In other embodiments, the temperature of the shell side stream is more than $T_b$+15° C., wherein $T_b$ is the boiling point of at least one of the liquid components of the tube side stream near its boiling point or boiling point of the azeotropic mixture formed by the mixture of components in the tube side stream.

The presently claimed invention shows at least one of the following advantages and improvements:

The insulation space (109) created between the distribution assembly (108) and the insulating tube sheet (103) protects the tube side stream at the distribution assembly from coming in contact with the higher temperatures of the shell side stream before the tube side stream has passed through the distribution assembly and into the tubes. The insulation space created, thereby protects the tube side stream from violent disruptive boiling at the distributing assembly which may lead to less uniform distribution of the tube side stream along the inner walls of the tubes and so a less efficient heat exchange between the shell side and the tube side streams. Additionally, it also protects the tube side stream from losses due to vapor formation. It is also evident from the examples that the requirement of the shell side stream is considerably reduced due to the introduction of the inlet insulation plate, which leads to an additional cost and energy saving.

The present invention is illustrated in more detail by the following embodiments and combination of embodiments which result from the corresponding dependency references and links:

1. A heat exchanger (100) comprising:
a shell (101);
a tube side inlet (106) and a tube side outlet (107);
a shell side inlet (105) and a shell side outlet (104);
a plurality of tubes (102);
a distribution assembly (108);
an inlet tube sheet (114) and an outlet tube sheet (112); and
an insulation tube sheet (103);
wherein,
the insulation tube sheet (103) is arranged between the distributor assembly (108) and the shell side outlet (104) to create an insulation space (109) there between; and
the tubes (102) are fitted inside the shell (101) between the distributor assembly (108) and the outlet tube sheet (112) and are in communication with the tube side inlet (106) through the distributor assembly (108) and the tube side outlet (107).

2. The heat exchanger according to embodiment 1, wherein the insulation space (109) insulates said tube side inlet (106) and said distribution assembly (108) from said shell (101)

3. The heat exchanger according to any one of embodiments 1 to 2, wherein the shell side inlet (105) allows the ingress and the shell side outlet (104) allows the egress of the shell side stream; and the tube side inlet (106) allows the ingress and the tube side outlet (107) allows the egress of the tube side stream.

4. The heat exchanger according to any one of the preceding embodiments, wherein the position of the insulation tube sheet (103) relative to the distribution assembly (108) is based on the temperature and boiling point of at least one component of the tube side stream near its boiling point, and the temperature of said shell side stream.

5. The heat exchanger according to embodiment 4, wherein the tube side stream is a liquid stream at the tube side inlet (106).

6. The heat exchanger according to any one of the preceding embodiments, wherein the tubes (102) are arranged in parallel inside the heat exchanger.

7. The heat exchanger according to any one of the preceding embodiments, wherein the insulation space (109) is fitted with a vent nozzle (110).

8. The heat exchanger according to any one of the preceding embodiments, wherein the insulation space (109) is filled with air.

9. The heat exchanger according to any one of the preceding embodiments, wherein the tube side inlet (106) of the shell is fitted with one or more flow aiding inlet (111).

10. The heat exchanger according to any one of the preceding embodiments, wherein the heat exchanger is a one-stage or a multi-stage heat exchanger having each stage of the heat exchangers connected in series.

11. The heat exchanger according to embodiment 10, wherein the heat exchanger is a multi-stage heat exchanger, in which the insulation tube sheet (103) is arranged between the distributor assembly (108) and the shell side outlet (104) for each heat exchanger.

12. The heat exchanger according to any one of the preceding embodiments, wherein the insulation tube sheet (103) is made of a heat resistant material.

13. The heat exchanger according to embodiment 12, wherein the heat resistant material is teflon.

14. The heat exchanger according to any one of the preceding embodiments, wherein the heat exchanger comprises inlet tube sheet (114) in the shell side.

15. The heat exchanger according to any one of the preceding embodiments, wherein the heat exchanger comprises one or more baffle (113) in the shell side.

16. The heat exchanger according to any one of the preceding embodiments, wherein the distributing assembly (108) is a distributing plate with multiple holes (1081).

17. The heat exchanger according to embodiment 16, wherein the multiple holes on the distributing plate have a diameter in the in the range of 1 mm to 100 mm.

18. The heat exchanger according to any one of the preceding embodiments, wherein the plurality of tubes (102) are laid out on a square pitch.

19. The heat exchanger according to any one of the preceding embodiments, wherein the plurality of tubes (102) are laid out on a triangular pitch.

20. The heat exchanger according to any one of the preceding embodiments, wherein the plurality of tubes (102) are laid out on a hexagonal pitch.

21. The heat exchanger according to any one of the preceding embodiments, wherein heat exchanger does not comprise an insulation space at the tube side outlet (107) of the shell.

22. The heat exchanger according to any one of the preceding embodiments, wherein the heat exchanger is an evaporator.

23. The heat exchanger according to any one of the preceding embodiments, wherein the evaporator is a falling film evaporator.

24. A method of exchanging heat using a heat exchanger according to any of the preceding embodiments comprising steps of:
i. feeding a tube side stream through said tube side inlet (106) to said distributing assembly (108),
ii. passing the tube side stream through said plurality of tubes (102),
iii. feeding a shell side stream through said shell side inlet (105) and
iv. exchanging the heat between the tube side stream in the plurality of tubes (102) with the shell side stream,
wherein the temperature of at least one of the liquid components of the tube side stream entering through the tube side inlet (106) to the distributing assembly (108) is near its boiling point; and the temperature of the shell side stream entering through the shell side inlet (105) is higher than at least one of the liquid components of the tube side stream at distributing assembly (108).

25. The method according to embodiment 24, wherein the shell side stream is selected from air, gas, liquid or a combination thereof.

26. The method according to embodiment 24, wherein the tube side stream comprises one or more liquid components, wherein the temperature of at least one of the liquid components of the tube side stream entering through the tube side inlet (106) to the distributor assembly (108) is less than $T_b$−15° C., wherein $T_b$ is the boiling point of at least one of the liquid components of the tube side stream near its boiling point.

27. The method according to embodiment 26, wherein the tube side stream comprises one or more liquid components, wherein the temperature of at least one of the liquid components of the tube side stream entering through the tube side inlet (106) to the distributor assembly (108) is less than $T_b$−10° C., wherein $T_b$ is the boiling point of at least one of the liquid components of the tube side stream near its boiling point.

28. The method of exchanging heat according to any of the embodiments 24 to 26, wherein the temperature of the shell side stream is more than $T_b$+5° C., wherein $T_b$ is the boiling point of at least one of the liquid components of the tube side stream near its boiling point.

29. The method according to embodiment 24, comprising v. feeding a gas through a flow-aiding inlet (111) and flowing the gas in the same direction as the tube side stream, wherein the velocity of the tube side stream is accelerated by the flow-aiding gas along the inner wall of the plurality of tubes (102).

30. A method of concentrating a liquid using a falling film heat exchanger according to embodiments 1 to 23 comprising the steps of:

i. feeding a tube side stream through said tube side inlet (106) to said distributing assembly (108), ii. passing the tube side stream through said plurality of tubes (102) having an inner wall and forming a film of the tube side stream along the inner wall, iii. feeding a shell side stream through said shell side inlet (105), iv. exchanging the heat between the tube side stream in the plurality of tubes (102) with the shell side stream, and v. obtaining a concentrated stream through said tube side outlet (107) of the shell;

wherein, the temperature of the tube side stream entering through the tube side inlet (106) to the distributing assembly (108) is near its boiling point; and the temperature of the shell side stream entering through the shell side inlet (105) is higher than the tube side stream at the distributing assembly (108).

31. The method according to embodiment 30, further comprising vi. feeding a gas through a flow-aiding inlet (111) and flowing the gas in the same direction as the liquid, wherein the velocity of the liquid is accelerated by the flow-aiding gas along the inner wall of the plurality of tubes (102).

32. The method according to embodiment 30, wherein the shell side stream is air, gas, steam, water, oil or secondary steam from a previous stage heat exchanger.

33. The method according to embodiment 30, wherein the tube side stream comprises one or more liquid components, wherein the temperature of at least one of the liquid components of the tube side stream entering through the tube side inlet (106) to the distributor assembly (108) is less than $T_b$−15° C., wherein $T_b$ is the boiling point of at least one of the liquid components of the tube side stream near its boiling point.

34. The method o according to embodiment 33, wherein the tube side stream comprises one or more liquid components, wherein the temperature of at least one of the liquid components of the tube side stream entering through the tube side inlet (106) to the distributor assembly (108) is less than $T_b$−5° C., wherein $T_b$ is the boiling point of at least one of the liquid components of the tube side stream near its boiling point.

35. The method according to any of the embodiments 30 to 34, wherein the temperature of the shell side stream is more than $T_b$+5° C., wherein $T_b$ is the boiling point of at least one of the liquid components of the tube side stream near its boiling point.

The presently claimed invention is illustrated by examples; however, the subject matter of the presently claimed invention is not limited to the examples given.

EXAMPLE

Table 1 and table 2 shows two sets comparative and inventive examples where a large-scale heat exchanger is operated with and without an insulation plate installed. It is evident from the tables that incorporation of an insulating tube sheet provided improved heat exchange benefits between the tube side stream and the shell side stream. The insulation tube sheet ensured the free flow of tube side fluid through plurality of tubes without formation of bubbles and breaking uniform flow.

TABLE 1

| Example and Duration | Avg. Usage of steam lb/hr | Product produced lb/hr | Total steam used lb |
|---|---|---|---|
| Comparative Example 1 01 Jul. 2014 to 31 Dec. 2014 (without insulation tube plate) | 9,374 | 44,866 | 41,395,584 |
| Inventive Example 1 01 Jul. 2015 to 31 Dec. 2015 (Comparative Ex 1 with the insulation tube plate installed) | 5,270 | 42,129 | 23,272,320 |
| Savings | 4,104 | | 18,123,264 |

TABLE 2

| Example Duration | Avg. Usage of steam lb/hr | Product produced lb/hr | Total steam used lb |
|---|---|---|---|
| Comparative Example 2 01 Jul. 2014 to 29 Dec. 2014 (without insulation tube plate) | 9,613 | 44,866 | 41,989,584 |
| Inventive Example 2 01 Jan. 2016 to 30 Jun. 2016 (Comparative Ex 2 with the insulation tube plate installed) | 7,496 | 43,205 | 32,742,528 |
| Savings | 2,117 | | 9,247,056 |

The invention claimed is:

1. A heat exchanger (100) comprising:

a shell (101);

a tube side inlet (106) and a tube side outlet (107);

a shell side inlet (105) and a shell side outlet (104);

a plurality of tubes (102);

a distribution assembly (108);

an inlet tube sheet (114) and an outlet tube sheet (112); and an insulation tube sheet (103);

wherein the insulation tube sheet (103) is arranged between the distributor assembly (108) and the shell side outlet (104) to create an insulation space (109) there between;

the insulation space (109) insulates said tube side inlet (106) and said distribution assembly (108) from said shell (101); and the tubes (102) are fitted inside the shell (101) between the distributor assembly (108) and the outlet tube sheet (112) and are in communication with the tube side inlet (106) through the distributor assembly (108) and the tube side outlet (107).

2. The heat exchanger according to claim 1, wherein the shell side inlet (105) allows the ingress and the shell side outlet (104) allows the egress of the shell side stream; and the tube side inlet (106) allows the ingress and the tube side outlet (107) allows the egress of the tube side stream.

3. The heat exchanger according to claim 1, wherein the position of the insulation tube sheet (103) relative to the distribution assembly (108) is based on the temperature and boiling point of at least one component of the tube side stream near its boiling point, and the temperature of said shell side stream.

4. The heat exchanger according to claim 3, wherein the tube side stream is a liquid stream at the tube side inlet (106).

5. The heat exchanger according to claim 1, wherein the tubes (102) are arranged in parallel inside the heat exchanger.

6. The heat exchanger according to claim 1, wherein the insulation space (109) is fitted with a vent nozzle (110).

7. The heat exchanger according to claim 1, wherein the insulation space (109) is filled with air.

8. The heat exchanger according to claim 1, wherein the tube side inlet (106) of the shell is fitted with one or more flow aiding inlet (111).

9. The heat exchanger according to claim 1, wherein the heat exchanger is a one-stage or a multi-stage heat exchanger having each stage of the heat exchangers connected in series.

10. The heat exchanger according to claim 9, wherein the heat exchanger is a multi-stage heat exchanger, in which the insulation tube sheet (103) is arranged between the distributor assembly (108) and the shell side outlet (104) for each heat exchanger.

11. The heat exchanger according to claim 1, wherein the insulation tube sheet (103) is made of a heat resistant material.

12. The heat exchanger according to claim 11, wherein the heat resistant material is teflon.

13. The heat exchanger according to claim 1, wherein the heat exchanger comprises inlet tube sheet (114) in the shell side.

14. The heat exchanger according to claim 1, wherein the heat exchanger comprises one or more baffle (113) in the shell side.

15. The heat exchanger according to claim 1, wherein the distributing assembly (108) is a distributing plate with multiple holes (1081).

16. The heat exchanger according to claim 15, wherein the multiple holes on the distributing plate have a diameter in the range of 1 mm to 100 mm.

17. The heat exchanger according to claim 1, wherein the plurality of tubes (102) are laid out on a square pitch.

18. A method of exchanging heat using a heat exchanger according to claim 1 comprising steps of:

i. feeding a tube side stream through said tube side inlet (106) to said distributing assembly (108), ii. passing the tube side stream through said plurality of tubes (102), iii. feeding a shell side stream through said shell side inlet (105) and iv. exchanging the heat between the tube side stream in the plurality of tubes (102) with the shell side stream, wherein the temperature of at least one of the liquid components of the tube side stream entering through the tube side inlet (106) to the distributing assembly (108) is near its boiling point; and the temperature of the shell side stream entering through the shell side inlet (105) is higher than at least one of the liquid components of the tube side stream at distributing assembly (108).

19. A method of concentrating a liquid using a falling film heat exchanger according to claim 1 comprising the steps of:

i. feeding a tube side stream through said tube side inlet (106) to said distributing assembly (108), ii. passing the tube side stream through said plurality of tubes (102) having an inner wall and forming a film of the tube side stream along the inner wall, iii. feeding a shell side stream through said shell side inlet (105), iv. exchanging the heat between the tube side stream in the plurality of tubes (102) with the shell side stream, and v. obtaining a concentrated stream through said tube side outlet (107) of the shell;

wherein, the temperature of the tube side stream entering through the tube side inlet (106) to the distributing assembly (108) is near its boiling point; and the temperature of the shell side stream entering through the shell side inlet (105) is higher than the tube side stream at the distributing assembly (108).

* * * * *